US007918309B1

(12) United States Patent
Vierra et al.

(10) Patent No.: US 7,918,309 B1
(45) Date of Patent: Apr. 5, 2011

(54) APPARATUS FOR PRODUCING A CONTINUOUS SONIC BOOM

(76) Inventors: Robert Kenneth Vierra, Reno, NV (US); Anthony Ray Cocucci, Reno, NV (US)

( * ) Notice: Subject to any disclaimer, the term of this patent is extended or adjusted under 35 U.S.C. 154(b) by 0 days.

(21) Appl. No.: 12/803,794

(22) Filed: Jul. 7, 2010

(51) Int. Cl.
*G10K 13/00* (2006.01)

(52) U.S. Cl. ..... 181/161; 181/162; 116/137 A; 116/140; 116/144

(58) Field of Classification Search ..... 181/161, 181/162; 116/137 A, 140, 144
See application file for complete search history.

(56) References Cited

U.S. PATENT DOCUMENTS 2,664,850 A * 1/1954 Smith ..... 116/137 A
3,399,731 A * 9/1968 Giles, Jr. ..... 416/237
3,416,628 A * 12/1968 Bschorr et al. ..... 181/142
3,713,417 A * 1/1973 Shugart ..... 116/137 A
3,830,193 A * 8/1974 Sobrinho ..... 116/137 A
6,626,640 B2 * 9/2003 Ivanovic ..... 415/142
2009/0071504 A1 * 3/2009 Ahn et al. ..... 134/1

FOREIGN PATENT DOCUMENTS

JP 02274242 A * 11/1990

* cited by examiner

*Primary Examiner* — Forrest M Phillips

(57) ABSTRACT

Herein taught is an apparatus for producing a continuous sonic boom that is simplified having few components. Namely, a motor, a rotating motor shaft, a rotor and a power source. The rotor is interconnected onto the rotating motor shaft, thus upon energizing, the motor rotates the rotor faster than the speed of sound resulting in production of a continuous sonic boom. Also, the rotor includes various configurations and the tips thereof are variable in shape and size. Furthermore, the apparatus is contained within different types of support means and also we provide a deflective sonic wave focal point projection mechanism.

15 Claims, 4 Drawing Sheets

APPARATUS FOR PRODUCING A CONTINUOUS SONIC BOOM

FIELD OF THE INVENTION

This invention relates in general to apparatuses and/or devices that are used for generating a sonic boom. More particularly, the invention pertains to a simplified apparatus that is formed from very few parts, namely, a motor, a rotating motor shaft, a rotor and a power source, respectively. The novel apparatus attains the desired results simply by the rotation of a rotor which is rotated faster than the speed of sound, resulting in the production of a continuous sonic boom.

BACKGROUND OF THE INVENTION

There are numerous reasons for experimentation with reproduction of a sonic boom. For example, a sonic boom can be useful for avalanche control. Currently, snow resorts and the like must often cause an avalanche so as to provide a safe environment for skiers. The most common means of producing an avalanche is use of explosives. This practise is very costly and also can be very dangerous for technicians. Furthermore, explosives are not environmentally friendly due to use of chemicals which can be absorbed by the snow, resulting in contamination of water and also chemical fumes are considered a pollutant. Therefore, use of explosives for producing an avalanche is not feasible, due to the dangers involved, high expense, and environmental concerns, etc.

Another very important use for production of a sonic boom is resolve issues associated within the aeronautical field. For example, the sonic boom generated by an aircraft flying at supersonic speeds has proven a major impediment in enhancing air travel. With the de minimus exception of the Concorde, and the briefly proposed Boeing "Sonic Cruiser", essentially all increases in air speed in civil aviation occurred between 1903 and the introduction in the early 1960's of the Convair 990. For over forty years there has been little increase in the cruising speed of civil airliners and business aircraft.

The sonic boom has undermined much of the economics of supersonic travel. Sonic booms proved damaging and annoying, which resulted in supersonic flight over land areas being banned. With supersonic flight limited to overwater flights, the market for such aircraft was both limited, and aircraft developed for such operations could not be economically redirected to overland use where their supersonic capabilities were of little use.

Eliminating the ill effects of the sonic boom would be facilitated by better understanding of the effects of sonic booms. Some of those effects are perceptual, that is, sonic booms are undesirable over populated areas simply because people do not like them. To better study perceptual issues a real sonic boom reproduction apparatus is necessary.

Within the known prior art there have been only a few concepts for reproduction of a sonic boom. For example, the National Aeronautics and Space Administration, has long recognized the need for sonic boom research and has built one sonic boom Simulator at the Langley Research Center in Hampton, Va. The Langley sonic boom Simulator is a person-rated, airtight, loudspeaker driven booth capable of accurately reproducing user-specified sonic boom waveforms at peak sound pressure levels up to approximately 138 dB. Input waveforms are distorted to compensate for non-uniformities in the frequency response characteristics of the booth and sound reproduction system.

The small size and air tight features of the Langley facility underlie some of that facility's limitations. The facility takes a very direct approach in attempting to reproduce the sound of a sonic boom. The chamber is air tight and has rigid walls to support the low frequencies present in a sonic boom to contain the slow pressure rise portion of the boom. However, most people experience a sonic boom under near free field conditions, which a small air tight chamber cannot replicate. NASA viewed sonic boom simulators as having inherently non-uniform frequency responses due to enclosure of the air space. The answer was to use complex computer algorithms to adjust components of the sound spectrum. This has proven to be an extremely costly experimentation facility and the overall end results have not been successfully attained.

Other examples of known prior art include U.S. Pat. Nos. 7,530,424 and 3,442,115, both of which attempt to replicate a sonic boom. However, neither reference has proven to be successful or feasible. Also, each reference can only produce replication of one sonic boom at a time. Whereas, the present invention when activated, produces a "continuous sonic boom" which is most advantageous and heretofore has not been conceived and/or achieved. The actual results of a continuous sonic boom have never been documented and/or studied and the experiments conducted so far by the applicants have proven most informative and unusual results have been discovered.

Therefore, there is a great need for an inexpensive, simplified apparatus for producing a continuous sonic boom that can be feasibly incorporated for various uses. In the case of avalanche control the present invention can be easily transported to the area of choice, is safe for the technicians, it is environmentally friendly, cost effective and controlled in a safe effective manner.

Within the air natal field of art, the present invention has tremendous potential as the apparatus can be used for experimentation to facilitate technicians with aeronautical solutions to allow aircraft to be constructed to actually deflect and/or ricochet a sonic boom in an acceptable direction (such as upward rather than downward) which will overcome the undesirable effects and eliminate the restrictions pertaining to supersonic flight, etc.

OBJECTS AND ADVANTAGES OF THE PRESENT INVENTION

It is therefore a primary object of the present invention to provide a new and novel apparatus for producing a continuous sonic boom that is cost effective, is simplified in construction and use, is easily adaptable for numerous uses and will provide new informational statistics heretofore not attainable.

Another important object of the present invention is to provide a new and novel apparatus for producing a continuous sonic boom that can be made according to the end users needs and/or engineers specifications. Thus the invention is not limited in shape, size or to any particular configuration as there are numerous embodiments of choice.

Still a further object of the present invention to provide a new and novel apparatus for producing a continuous sonic boom that is constructed from existing prior art components, respectively. Thus no specialized equipment, tools, specialty parts are required for manufacture. Namely, the only necessary components are a motor, a rotating motor shaft, a rotor, and a power source. When assembled as taught herein the rotor is interconnected onto the rotating motor shaft and upon energizing, the rotor rotates faster than the speed of sound, thus resulting in production of a continuous sonic boom.

Yet another object of the present invention is to provide a new and novel apparatus for producing a continuous sonic boom that can be easily controlled via a remote control device so as to allow technicians and/or spectators to observe the overall performance from a safe distance.

Also another object of the present invention is to provide a new and novel apparatus for producing a continuous sonic boom that includes control means for adjusting speed of the rotor, deflection and/or directional focal point of the sonic wave. This is very important as this allows the apparatus to be utilized in specified areas of choice. For example, the sonic boom can be directed to a specific location within a snow drift to cause an avalanche or directed toward any specific target to cause a desired intentional disruption. Or when utilized within the aeronautical field, numerous experiments and tests can be performed pertaining to deflection of the sonic wave in relation to the construction and aerodynamics of aircraft.

Other objects and advantages will become apparent when taken into consideration with the following specification and drawings.

DETAILED DESCRIPTION OF THE DRAWINGS

Figure 1:
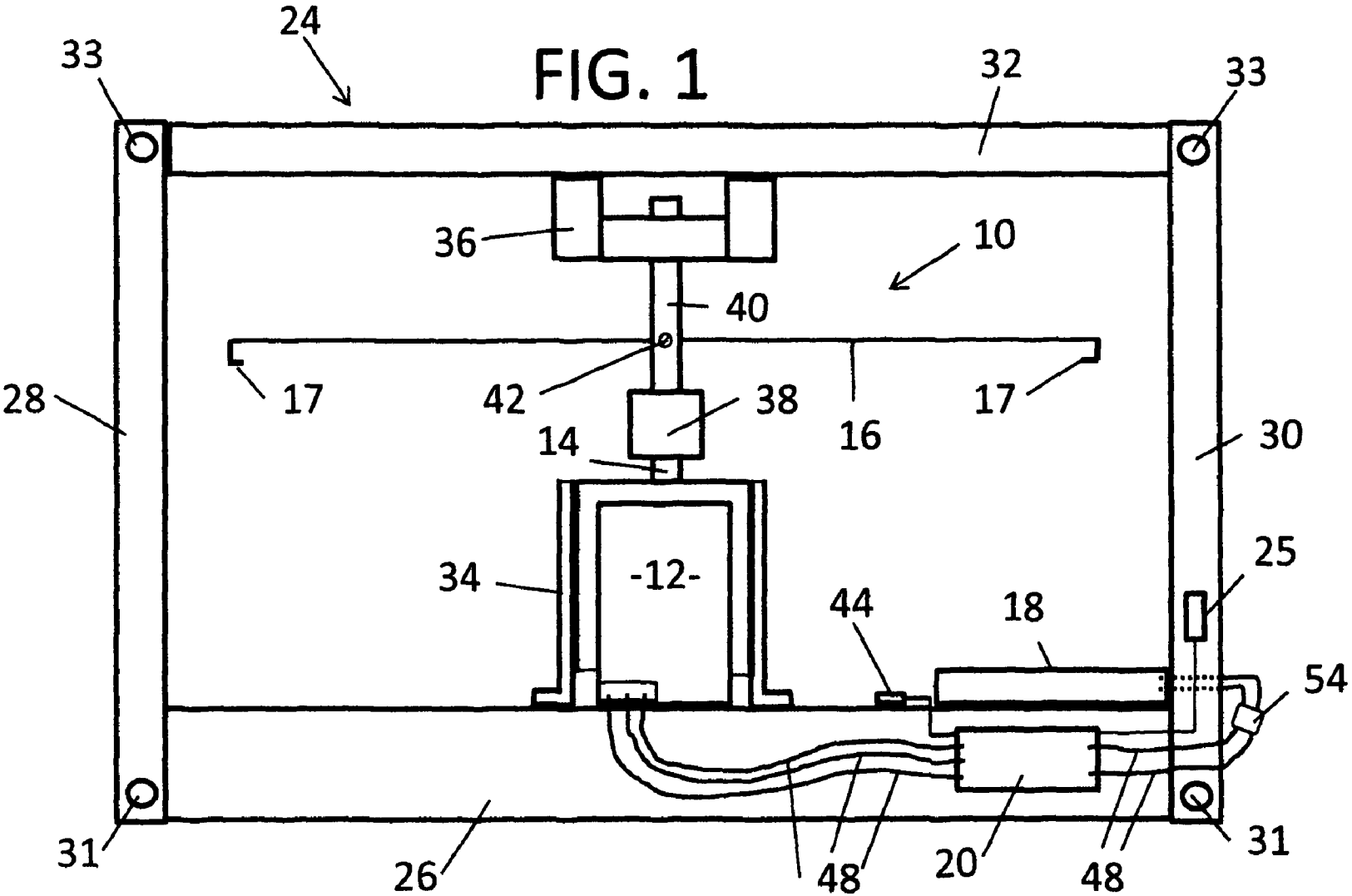
FIG. 1 is substantially a frontal overview of the present invention.
Figure 3:
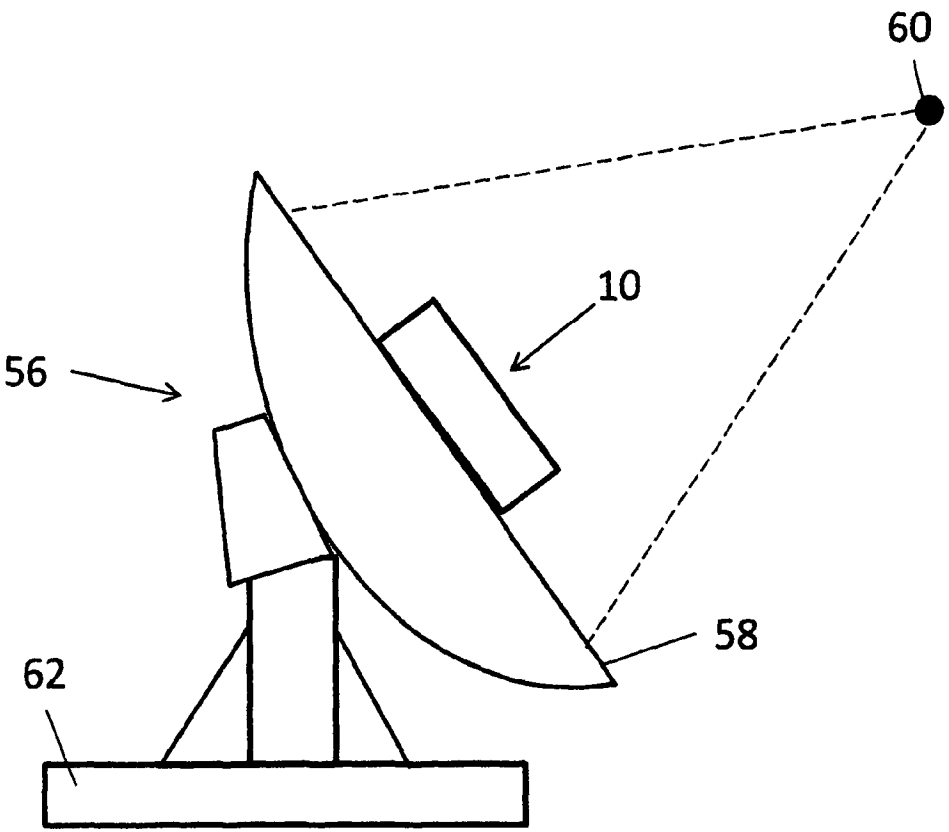
FIG. 3 is substantially a side overview depicting a deflective sonic wave focal point projection mechanism.
Figures 4, 5:
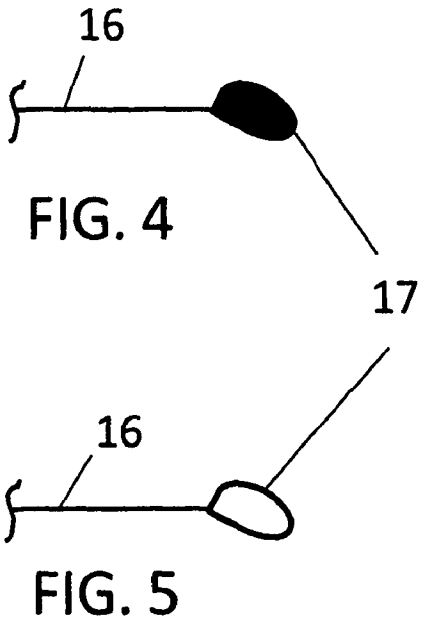
FIG. 4 is substantially a side view partially depicting the rotor having a hollow teardrop shaped tip.
FIG. 5 is substantially a side view partially depicting the rotor having a solid teardrop shaped tip.
Figures 7, 8:
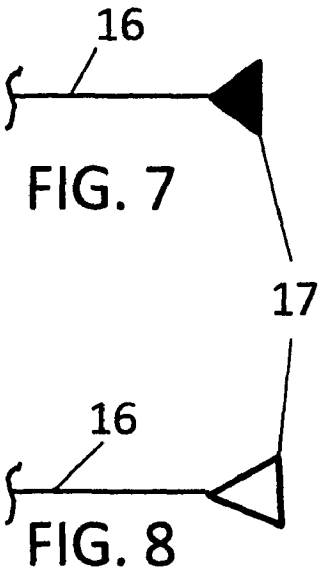
FIG. 7 is substantially a side view partially depicting the rotor having a solid triangular shaped tip.
FIG. 8 is substantially a side view partially depicting the rotor having a hollow triangular shaped tip.
Figures 10, 11:
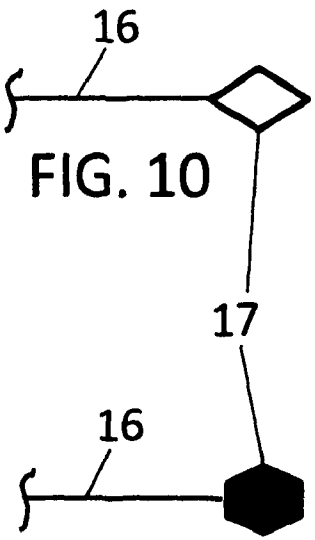
FIG. 10 is substantially a side view partially depicting the rotor having a hollow diamond shaped tip.
FIG. 11 is substantially a side view partially depicting the rotor having a solid hexagon shaped tip.
Figure 6:
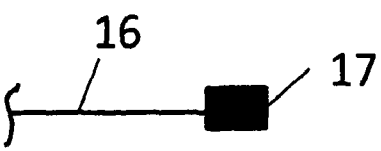
FIG. 6 is substantially a side view partially depicting the rotor having a solid rectangular shaped tip.
Figure 9:
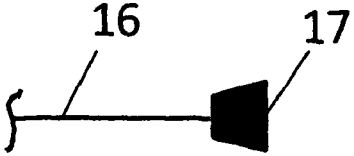
FIG. 9 is substantially a side view partially depicting the rotor having a solid trapezoid shaped tip.
Figure 12:
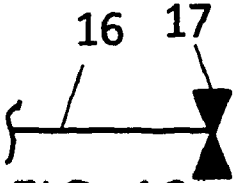
FIG. 12 is substantially a side view partially depicting the rotor having a solid hourglass shaped tip.
Figure 13:
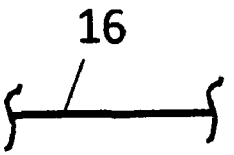
FIG. 13 is substantially a side view partially depicting the rotor having a different sized width.
Figure 14:
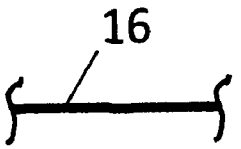
FIG. 14 is substantially a side view partially depicting the rotor having a different sized width.
Figure 15:
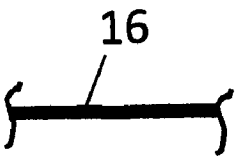
FIG. 15 is substantially a side view partially depicting the rotor having a different sized width.
Figure 16:
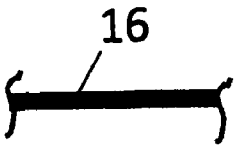
FIG. 16 is substantially a side view partially depicting the rotor having a different sized width.
Figure 17:
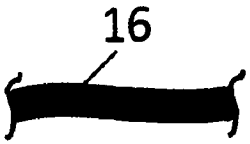
FIG. 17 is substantially a side view partially depicting the rotor having a different sized width and shape.
Figure 18:
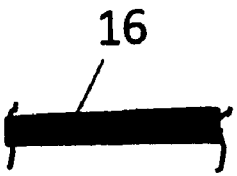
FIG. 18 is substantially a side view partially depicting the rotor having a different sized width and shape.

Referring now in detail to the drawings wherein like characters refer to like elements throughout the views. As depicted in FIGS. 1 & 3 (10) represents the general overview of the apparatus for producing a continuous sonic boom. The main necessary components include a motor (12), a rotating motor shaft (14), a rotor (16), a power source (18), a speed control device (20), and a remote control device (22) if required. It is to be understood the actual size, shape, support means, structure and assembly is variable and of engineering choice. Thus the invention is not to be limited to the following example as different sizes, shapes and assemblies have different results, operational parameters, specifications, etc.

The following is an example of one embodiment and operational parameters for the present invention:

The overall objective and desired results are achieved with the apparatus when the rotor attains a speed faster than the speed of sound or beyond Mach 1, respectively. In this example, we will use 750 miles per hour as a reference point to achieve. It is to be noted that there are many variables to be calculated and considered such as altitude, temperature and atmospheric pressure, etc.

Example configuration: The rotor (16) for this embodiment is 1 foot in diameter, thus resulting in the following equation, respectively. 1 foot (D)×350.32 rotations per second×"Pi" (3.14) equals 1100 feet per second at the outer ends and/or tips of rotor. Whereby, the rotor can achieve 750 mph and well beyond simply by increasing revolutions of the rotor per minute.

It is to be noted the apparatus can be made to accommodate different configurations of which provide variable options for different types of tests, for example, drag, weight, size, shape, etc. are all variable and adjustable and the different configurations may increase/decrease the attainability of how fast the rotor attains speeds of 750 mph and beyond. The stability of the apparatus configurations can also be studied at speed. There are no limits as to what can be studied while the apparatus is functioning.

The outer edge and/or outer tips of the rotor can be made of any shape, size and weight of engineering choice to enable study of dynamics at the tips that occur at high speeds. Purpose of this is to allow for the study of the aerodynamics at play . . . that are occurring at 750 mph and beyond.

The speed at which the rotor accelerates too and arrives at the 750 mph mark (and beyond) will provide important data, and/or details as to what is occurring. For example a slow arrival to the 750 mph point and beyond is going to yield data far different then a sudden arrival of 750 mph point.

The apparatus can also do testing in the speed range prior to the 750 mile per hour mark.

With further reference to the drawings, as noted the apparatus (10) includes a support means of engineering choice. It is to be noted any type of support means can be incorporated and numerous types are unlimited. Thus the following description for one possible support means is only exemplary and the invention is not to be limited to any specific support means.

The support means as depicted in FIG. 1 is a platform (24) of which is formed from a base plate (26) having a first end and a second end. The first end being fixedly attached onto a first upward extending support member (28) and the second end being fixedly attached onto a second upward extending support member (30) by suitable attachment means of choice, such as by screws (31) or the like. The first upward extending support member (30) and the second upward extending support member (30) being distanced apart and opposed to each other. The first upward extending support member (28) and the second upward extending support member (30) are interconnected by a cross member (32) by suitable attachment means of choice, such as screws (33). The base plate (26)

further includes a motor bracket (34) fixedly attached for stabilizing the motor (12) thereon. The cross member (32) further includes a bearing assembly (36) fixedly attached thereon and the bearing assembly (36) is interconnected onto the rotating motor shaft (14) by suitable attachment means of choice. These are the general assembly components.

It is to be understood the components, assembly, attachment means, etc. are variable and of engineering choice. Thus the following are only exemplary of possibilities for such. As further depicted in FIG. 1 the motor (12) is a 5.6 (HP) brushless motor, (2650 KV) (60,000) RPM and is securely mounted onto the base plate (26) by the motor bracket (34) by suitable attachment means of choice, such as bolts/nuts screws or the like, (not shown). The bearing assembly (36) is of engineering choice, such as 3 high speed bearings or the like. The actual bearing assembly as illustrated by (36) is not taught herein as bearing assemblies are standard technology and very well known in the art. The bearing assembly (36) is interconnected and in communication with the rotating motor shaft (14) via attachment means of engineering choice. For example, as depicted herein the attachment means is a standard collar (38) which is fixedly attached onto the rotating motor shaft (14) by suitable attachment means such as collar set screws (not shown) or the like. The collar (38) is further attached onto an upper rotating shaft member (40) by suitable attachment means such as collar set screws (not shown) and the upper rotating shaft member (40) is attached onto the bearing assembly (36) by suitable attachment means such as a standard high speed bearing carrier of which is associated with the bearing assembly (36), or the like. The rotor (16) is again made from any suitable material of engineering choice and is variable in length, width, size and shape. For example, it can be made from wire, plastic, rubber, wood, aluminum, steel, aerodynamic materials, etc. Also, the ends and/or tips (17) of the rotor (16) can be interchanged if desired so as to provide technicians with experimentation alternatives. It is to be understood the tips (17) are extremely important and it has been proven during our experiments that different configurations and/or different shaped tips each provide new and unusual results. For example, FIGS. 1 and 4-12 each depict a different shaped tip. Namely, L-shaped, teardrop shaped, rectangular shaped, triangular shaped, trapezoid shaped and hexagon shaped. Also, the tips (17) may be made in solid form or hollow. These are just some examples of possible various shapes, thus the tips are not limited to any specific shape, size, or material. Also, the tips (17) maybe fixedly attached and/or removably attached and/or interchangeable.

Figure 19:
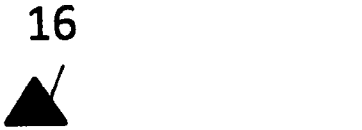
FIG. 19 is substantially an end view of the rotor having a different radial shape.
Figure 20:
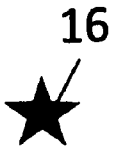
FIG. 20 is substantially an end view of the rotor having a different radial shape.
Figure 21:
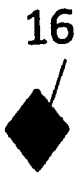
FIG. 21 is substantially an end view of the rotor having a different radial shape.

Still further the rotor can be attached by any suitable attachment means of engineering choice onto the upper rotating shaft member (40), such as by set screw(s) (42) or the like. It is also to be noted the rotor (16) can be one elongated member thread ably engaged through the upper rotating shaft member (40), or it can be made from two different pieces, and more importantly there may be more than one rotor if desired, and/or combinations of different types thereof, etc. Also, the actual shape and size of the rotor is variable and dependant on engineering choice. For example, FIGS. 13-18 depict various widths, shapes and sizes. Also, the rotor may be formed from an elongated material having different radial shapes, such as illustrated in FIGS. 19, 20 and 21. For example, the rotor may have a radial shape in the form of a triangle, star, diamond, etc. All of which provide different statistical results during testing and the like.

Figure 2:
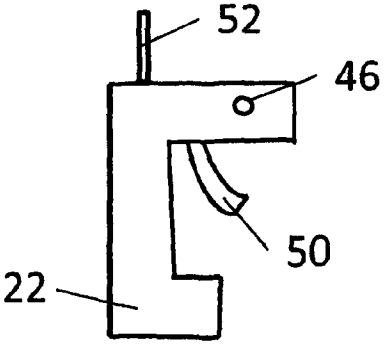
FIG. 2 is substantially a side view of a typical remote control device.

As previously noted the apparatus (10) further includes a speed control device (20) for varying the speed of the rotor (16). Again, any standard type of speed control device may be utilized as there are numerous pre-existing varieties available within the market. Thus, the speed control device (20) as depicted in FIG. 1 is only exemplary. The speed control device (20) includes standard operational components such as an on/off switch (44), electrical leads (48) for electrical communication between the motor (12) and the speed control device (20) and variable speed control options (not shown). The apparatus (10) further includes a remote control device (22) of which is again standard and is variable depending on engineering choice. Thus, the remote control device (22) as depicted in FIG. 2 is only exemplary of one possible variety. The a remote control device (22) is standard having an on/off switch (46), a throttle lever (50) and antenna (52) for communication between the remote control device (22) and the remote control receiver (25), etc. As previously noted the apparatus (10) further includes a power source (18) of engineering choice, thus the invention is not to be limited to any specific type of power source as numerous options for power are limitless. For exemplary purposes, the power source depicted herein is a standard lithium polymer battery 5000 MAH 16.8V, or the like. For ease of use, the power source (18) and the speed control device (20) maybe removably interconnected via a standard break away fastener (54) or the like.

Referring now to FIG. 3, which is substantially an alternative support means which further functions as a deflective sonic wave focal point projection mechanism (56). Again it is to be noted any suitable type of deflective mechanism of engineering choice may be utilized thus the deflective sonic wave focal point projection mechanism (56) as illustrated herein is only exemplary as numerous variations are unlimited. As illustrated, the deflective sonic wave focal point projection mechanism (56) includes a dish shaped mechanism (58), respectively, which is made from any suitable material of choice and which is of a shape and size to deflect sound waves in a specified outward direction toward a focal point (60). The dish shaped mechanism (58) further includes the apparatus (10) mounted thereon/therein by suitable attachment means of choice (not shown). It is to be noted the adjustment means for varying the focal point includes the apparatus (10) being movable between an outermost position and an innermost position. When the apparatus (10) assumes the outermost position, the continuous sonic boom is deflected and/or ricocheted off toward a focal point that is farther away. When the apparatus (10) assumes the innermost position, the continuous sonic boom is deflected and/or ricocheted to a focal point that is closer. However, the angle of the dish shaped mechanism (58) also adjusts the distance of the focal point. Therefore, upon the apparatus (10) producing the sonic boom the dish shaped mechanism (58) will deflect, redirect, bounce-off, or ricochet the sonic boom in a focused specified direction of choice toward a target. Furthermore, the dish shaped mechanism (58) is mounted in a traditional manner onto a support means of choice, such as pedestal (62) or the like.

It will now be seen we have herein provided a new and novel apparatus for producing a continuous sonic boom that can be made according to the end users needs and/or engineers specifications. The apparatus is very versatile and can be used for any application wherein the production of a sonic boom is desired and also allows technicians or the like to perform experiments in a manner heretofore not possible.

All though the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what we claim as new and desire to secure by Letters Patent is:

1. An apparatus for producing a continuous sonic boom comprising in combination:

a motor;

a rotating motor shaft;

a rotor;

and a power source;

said rotor being an elongated member formed of an elongated material, having a radial shape, the rotor having two distal ends, each respective end having thereon a tip, said rotor being interconnected onto said rotating motor shaft at a central position of the rotor, thus upon energizing said rotor rotates faster than the speed of sound resulting in the production of a continuous sonic boom.

2. The apparatus of claim 1 further includes a support means.

3. The apparatus of claim 2 wherein said support means is a platform, said platform includes a base plate having a first end and a second end; said first end being fixedly attached onto a first upward extending support member, said second end being fixedly attached onto a second upward extending support member, said first upward extending support member and said second upward extending support member being distanced apart and opposed to each other, said first upward extending support member and said second upward extending support member being interconnected by a cross member, said base plate having a motor bracket fixedly attached for stabilizing said motor thereon, said cross member having a bearing assembly fixedly attached thereon and said bearing assembly being interconnected onto said rotating motor shaft.

4. The apparatus of claim 2, wherein said support means is further functional as a deflective sonic wave focal point projection mechanism comprising: dish shaped mechanism which is of a shape and size to deflect sound waves in a specified outward direction toward a focal point, said dish shaped mechanism further includes said apparatus being fixedly mounted therein whereby, upon said apparatus producing said sonic boom said dish shaped mechanism will deflect, redirect, bounce-off, or ricochet said sonic boom in a focused specified direction toward a target and said dish shaped mechanism is mounted onto a support means of choice.

5. The apparatus of claim 1 further includes a speed control device.

6. The apparatus of claim 1 further includes a remote control device.

7. The apparatus of claim 1 wherein said power source is a battery.

8. The apparatus of claim 1 wherein said rotor is made having different radial shapes.

9. The apparatus of claim 8 wherein said different radial shapes include triangular, star and diamond.

10. The apparatus of claim 1 wherein said rotor includes different shaped tips.

11. The apparatus of claim 10 wherein said different shaped tips include teardrop, rectangular, triangular, trapezoidal, hexagonal and hourglass.

12. The apparatus of claim 10 wherein said different shaped tips are fixedly attached.

13. The apparatus of claim 10 wherein said different shaped tips are removably attached.

14. The apparatus of claim 13 wherein said different shaped tips are interchangeable.

15. The apparatus of claim 1 wherein said rotor being an elongated member formed from an elongated material, said elongated material includes wire, plastic, rubber, wood, aluminum, or steel.

* * * * *